United States Patent [19]

Davis

[11] Patent Number: 4,503,612

[45] Date of Patent: Mar. 12, 1985

[54] SAFETY GUARD EQUIPPED CARDBOARD BOX CUTTER

[76] Inventor: Raymond E. Davis, 3636 Remington, Plano, Tex. 75023

[21] Appl. No.: 521,036

[22] Filed: Aug. 8, 1983

[51] Int. Cl.[3] ..... B26B 29/02

[52] U.S. Cl. ..... 30/2; 30/293; 30/294

[58] Field of Search ..... 30/2, 293, 294, 286, 30/289, 295

[56] References Cited

U.S. PATENT DOCUMENTS

| | | | |
|---|---|---|---|
| 2,376,887 | 5/1945 | Walters | 30/286 X |
| 2,644,230 | 7/1953 | Anderson | 30/2 X |
| 2,695,447 | 11/1954 | Maynard | 30/2 |
| 2,730,800 | 1/1956 | Bailey | 30/2 |
| 2,743,523 | 5/1956 | Honey | 30/2 |
| 4,086,698 | 5/1978 | Sparks | 30/2 |
| 4,091,537 | 5/1978 | Stevenson | 30/294 X |

*Primary Examiner*—Jimmy C. Peters

*Attorney, Agent, or Firm*—Warren H. Kintzinger

[57] ABSTRACT

A resiliently deflectable spring safety guard equipped cardboard box cutter with the spring safety guard formed from strip spring metal with a formed projection extended through an opening in a cardboard box guide surface of the cutter presenting a protective profile of spring steel as a safety guard projecting below a cutting edge projecting beneath the cutter box guide surface. The strip spring metal safety guard retracts as the box is being cut and as the cutter is lifted away from a box just cut the guard shield returns to the blade protection state protecting from the possibility of accidental hand contact with the cutting blade.

15 Claims, 9 Drawing Figures

SAFETY GUARD EQUIPPED CARDBOARD BOX CUTTER

Figure 1:
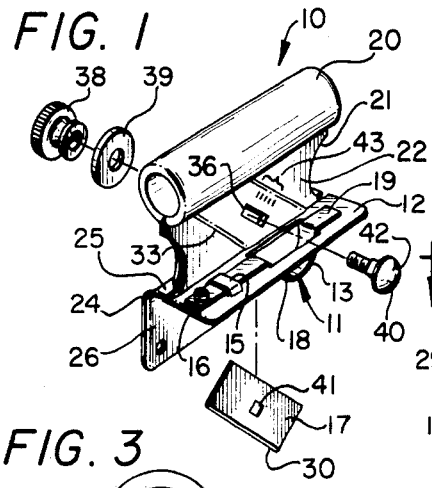

This invention relates in general to hand held cutters such as cardboard box cutters and more particularly to safety guard equipped cardboard box cutters.

Hand held cutters such as box cutters have been in wide spread use through many years and many users who use such cutters in their work have inadvertently made hand contact with the cutting edge of the naked blade. While most resulting cut injuries are relatively minor they can be quite painful and dehabilitating. This persistant problem should be deviated if at all possible with the hazzard of accidental cut injury minimized. It is important to be able to store and use a cardboard box cutter with confidence that there is not a lurking cut injury problem.

It is therefore a principal object of this invention to lessen the hazzard of injury with hald held cutters such as cardboard box cutters.

Another object is to provide such a cardboard box cutter that can be used with confidence through substantially no threat of injury.

A further object is to provide such a cardboard box cutter equipped with a safety guard preventing open exposure of a naked blade cutting edge.

Still another object is to provide a cardboard box cutter with a safety guard in blade shielding position when not in use and retractable for box cutting use.

Features of the invention useful in accomplishing the above objects include, in a safety guard equipped cardboard box cutter, a spring metal safety guard formed from strip spring metal with a cam formed projection extended through an opening in a cardboard box guide surface plate of the cutter. The cam formed projection presents a protective profile resiliently spring positioned as a safety guard projecting from the box guide surface plate below the cutting edge of the blade mounted in the cutter and projecting beneath the cutter box guide surface plate. The strip spring metal safety guard retracts as the box is being cut and as the cutter is lifted away from a box just cut the guard shield returns to the blade protection state giving protection from accidental hand contact with the cutting blade.

Specific embodiments representing what are presently regarded as the best modes of carrying out the invention are illustrated in the accompanying drawings.

Figure 2:
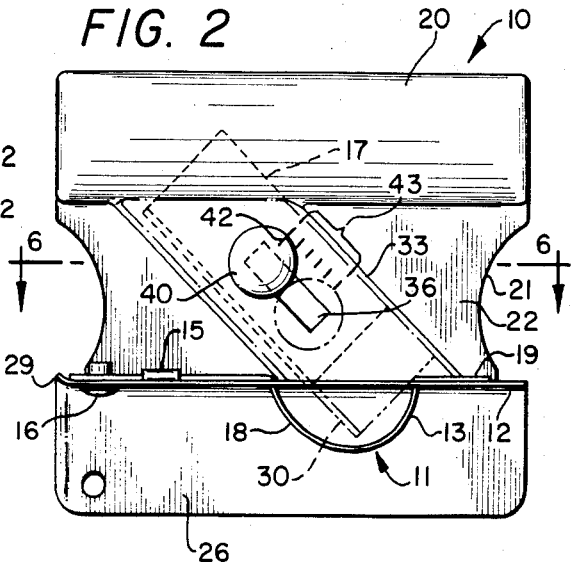
Figure 3:
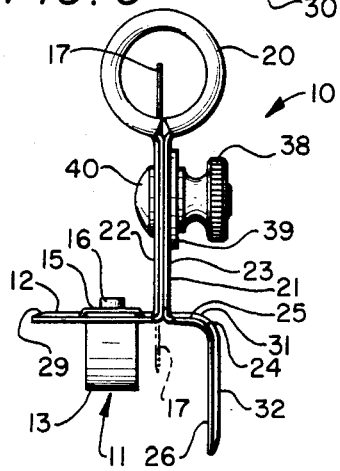
Figure 4:
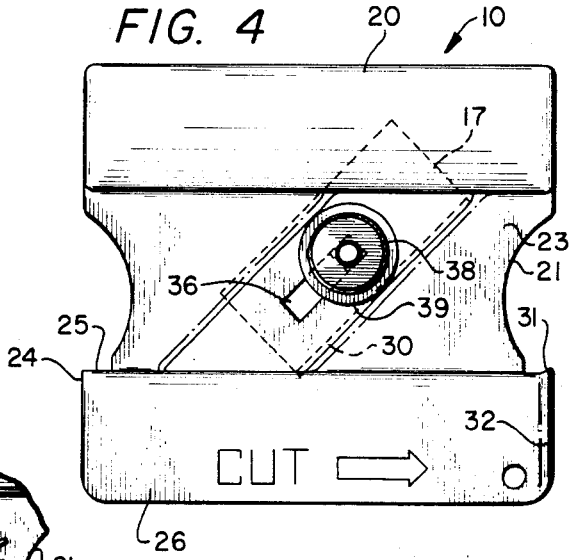
Figure 5:
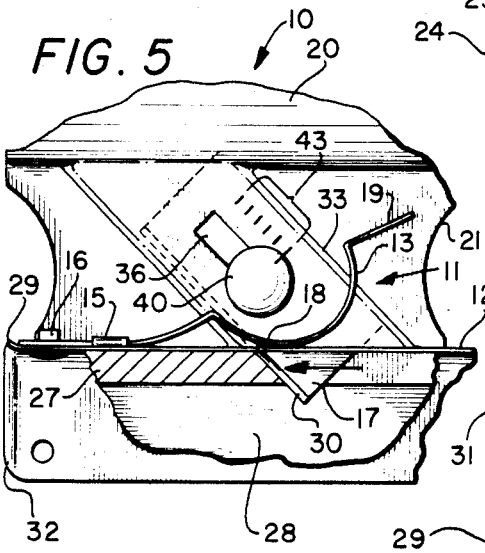
Figure 6:
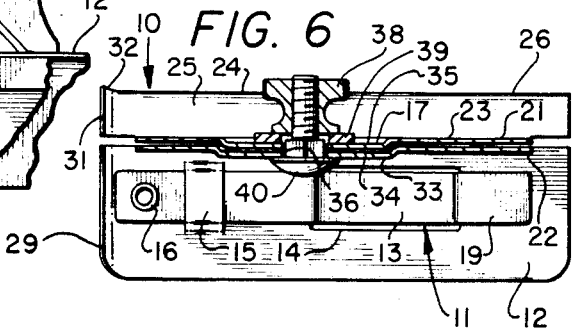
Figure 7:
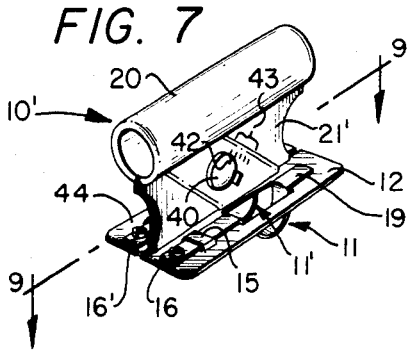
Figure 8:
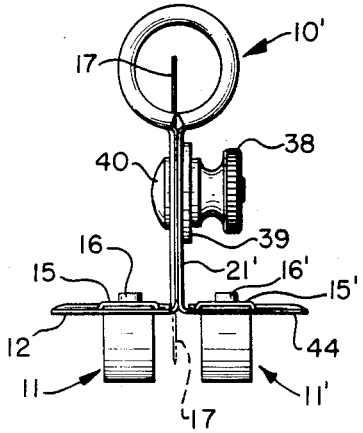
Figure 9:
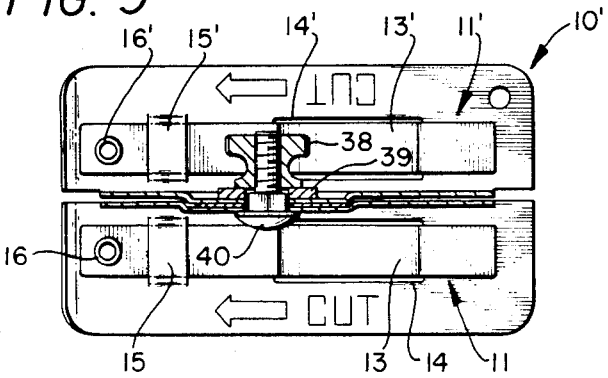

In the drawings:

FIG. 1 represents a perspective and partially exploded view of a safety guard equipped cardboard box cutter;

FIG. 2, a front elevation view of the cardboard box cutter;

FIG. 3, a rear end elevation view;

FIG. 4, a back elevation view;

FIG. 5, a partial front elevation view like FIG. 2 with the spring metal safety guard resiliently retracted with the exposed blade cutting a box top;

FIG. 6, a top elevation section view taken from line 6—6 of FIG. 2;

FIG. 7, a perspective view of an alternate flat surface cardboard cutter embodiment with the opposite side co-planer flat guide surface plates with a resiliently spring positioned safety guard projecting below the downward extended cutting edge of a blade mounted in the center body of the cutter;

FIG. 8, a rear end elevation view of flat surface cardboard cutter embodiment of FIG. 7; and, FIG. 9, a top elevation section view of the flat surface cardboard cutter taken from line 9—9 of FIG. 7.

Referring to the drawings:

The cardboard box cutter 10 of FIGS. 1–6 is shown to include a safety guard II formed from a strip of spring metal extending from a mounting interconnection at one end with the cutter flat guide surface plate 12, generally overlying the top of plate 12, to a safety guard formed projection 13 that extends down through rectangular opening 14 in plate 12.

The mounting interconnection may be one, as shown, with the mounting end slipped through an overlay strap 15 press formed in the cutter flat guide surface plate 12 and a rivet 16 at the leading end of the cutter in the direction of cutting travel. The ribbon of strip spring metal forming safety guard II extends sufficiently far from its mounting on the top of flat guide surface plate 12 to permit full resilient flexing of the safety guard formed projection 13 from the down blade 17 shielding position of FIGS. 1–3 to the cardboard box displaced resiliently retracted state shown in FIG. 5 as is the state whenever the cutting tool is being used as a box cutter. The strip of spring metal forming safety guard II has projection 13 to stamp formed as to present a sloped cam action forward (in the direction of tool cutting use) face 18 and a rearward tab end extension 19 overlying a portion of the top of the rear of flat guide surface plate 12.

The safety guard equipped cardboard box cutter 10 is formed with a rounded tube like top handle 20 adapted to be grasped by a user. A body portion 21 extends downward from the tube like top handle 20 in the form of two stamp formed halves 22 and 23. The front half 22 as an extension from the sheet metal forming the handle 20, extends down to the cutter flat guide surface plate 12 that is also an extension from the sheet metal forming the handle 20 and the front half 22 of the body portion 21. The cutter flat guide surface plate 12 is form bent at approximately ninety degrees from the bottom of the front half 22 of the body portion 21. The back half 23 of the body portion 21, as an extension from the sheet metal forming the handle 20, extends down to a cutter guide section 24 that has a flat portion 25 generally coplanar with the cutter flat guide surface plate 12 extending to the rear while plate 12 extends forwardly from body portion 21. Further, cutter guide section 24 is formed with a rearward downwardly extended guide portion 26 bent downward at substantially a ninety degree angle from the flat portion 25. Guide portion 26 acts as a guide for the cutter 10 in sliding along the top side of a cardboard box 27 being cut open at the top with the spacing between the guide portion 26 and the cutting blade 17 to clear the thickness of the box side wall 28. The cutter flat guide surface plate 12 is formed with a turned up leading edge lip 29 in the direction of travel for the cutting edge 30 of blade 17 to fullfil its cutting function. In like manner the leading edge of the flat portion 25 is formed with a turned up leading edge lip 31 that extends through the bend to bent out lip 32 of downwardly extended guide portion 26.

In the body portion 21 front half 22 is stamped with a slanted parallel sided boss 33 with an internal depression 34 and back half 23 is stamped parallel sided boss 35 with the projection thereof of less width than the internal depression 34 of front half boss 33 to extend thereinto and provide a mounting and carrying space for blade 17. A slot 36 is provided in boss 33 and a slot 37 is provided in boss 35 with slots 36 and 37 in alignment providing position adjustment capability for setting position of the cutting blade 17 between the extended position indicated in phantom in FIG. 2 to the blade retracted state extending up to within the tubular handle 20 indicated in dotted lines. The nut 38, washer 39 and bolt (or screw) 40 assembley what extends through slots 36 and 37 and through blade opening 41 locks the blade 17 in selected settings position indicated by the scribe mark 42 on the bead of bolt 40 alignment with scale markings 43.

Reffering now to the flat surface cardboard cutter 10' of FIGS. 7, 8, and 9 the portions the same with cutter 10 of FIGS. 1–6 are numbered the same since with this cutter 10' other than the rear extension 44 from the bottom of body portion 21' back half 23' and a second safety guard 11 mounted thereon. The rear extension 44 is a cutter flat guide surface plate that is substantially a mirror image of plate 12. With the rear extension 44 the second safety guard 11' is mounted thereon with an overlay strap 15' and a rivet 16' and with its safety guard formed projection 13' extended down through rectangular opening 14' in the extension 44. Thus, a cutter 10' is provided that may be used to cut across flat sheets of cardboard that has two resiliently spring positioned safety guards projecting on opposite side down below the downward extent of the cutting edge of a blade 17 mounted in the center body portion 21' of the cutter.

Whereas this invention has been described with respect to several embodiments thereof, it should be realized that various changes may be made without departing from the essential contributions to the art made by the teachings hereof.

I claim:

1. A safety guard equipped cardboard cutter comprising: a body section generally enclosing and mounting a cutter blade; a handle at the top of said body section; guide plate means for supporting and guiding the cutter over cardboard being cut by the cutter; said cutter blade positionable in its mounting in said body section with a cutting edge projection below said guide plate means sufficiently far to cut through the thickness of cardboard being cut; and a resiliently deflectable spring safety guard mounted on said cardboard cutter with a guard shield projection extended through an opening in said guide plate means presenting a protective profile for said cutter blade beneath said guide plate means; wherein said resiliently deflectable spring safety guard is mounted on said guide plate means with the safety guard retractable by cardboard being cut as the cardboard is being cut and as the cutter is lifted away from cardboard just cut the guard shield of said safety guard returns to the blade protection state from the possibility of accidental hand contact with the cutting edge of the cutter blade; said resiliently deflectable spring safety guard is stamp formed from a strip of spring metal; and wherein said guard shield is a stamp formed projection in the strip of spring metal forming said resiliently deflectable spring safety guard.

2. The safety guard equipped cardboard cutter of claim 1, wherein said stamp formed projection in the strip of spring metal forming said safety guard is formed to present a sloped cam action forward face in the direction of tool cutting use.

3. The safety guard equipped cardboard cutter of claim 2, wherein mounting means interconnects said strip of spring metal forming said safety guard to the top of said guide plate means at the forward portion thereof in the direction of tool cutting use; and the ribbon of strip spring metal forming said safety guard extends sufficiently far from the said mounting means interconnect thereof to permit full resilient flexing of the safety guard formed projection from the down blade shielding position to the cardboard displaced resiliently retracted state and return to the down blade shielding position.

4. The safety guard equipped cardboard cutter of claim 3, wherein said body section generally enclosing and mounting a cutter blade is formed of a front half and a back half generally enclosing said cutter blade therebetween; slot means in said front half and matching aligned slot means in said back half of said body section; and blade position locking means whereby said blade may be adjusted between a maximum extended cutting position and a retracted position.

5. The safety guard equipped cardboard cutter of claim 4, wherein said handle at the top of said body section is a hollow handle; and said blade in the retracted position extends to within said hollow handle.

6. The safety guard equipped cardboard cutter of claim 4, wherein said front half and said back half of said body section are two stamp formed half extensions from said handle at the top of said body section with the handle a hollow handle.

7. The safety guard equipped cardboard cutter of claim 6, wherein one of said front and back halves of said body section is stamp formed with a slanted parallel sided boss with an internal depression, and the other of said front and back halves of said body section is stamp formed with a boss projection thereof of less width than said boss internal depression of the one of the halves and extension thereof into said boss internal depression to provide a mounting and carrying space, for said blade, extending through said body section from top to bottom.

8. The safety guard equipped cardboard cutter of claim 6, wherein said guide plate means is an extension from sheet metal forming said handle and the front half of said body section form bent at approximatively ninety degrees from the bottom of the front half of said body section.

9. The safety guard equipped cardboard cutter of claim 8, wherein the back half of said body section is also an extension of sheet metal forming said handle and extends down to a guide section; and with said guide section an extension of said back half of said body section having a flat portion generally coplanar with said guide plate means.

10. The safety guard equipped cardboard cutter of claim 9, wherein said guide plate means extends forwardly from said body section and said flat portion extends to the rear from said body section.

11. The safety guard equipped cardboard cutter of claim 10, wherein said guide section extends through said flat portion to a rearward downwardly extended guide portion bent downward at substantially a ninety degree angle from said flat portion for the cardboard cutter to be a cardboard box cutter slidable in use along the corner of a cardboard box.

12. The safety guard equipped cardboard cutter of claim 11, wherein spacing between said cutting blade and said rearward downwardly extended guide portion is greater than the wall thickness of cardboard boxes being cut opened through use of the cardboard box cutter.

13. The safety guard equipped cardboard cutter of claim 10, wherein a second resiliently deflectable spring safety guard is mounted on said flat portion with a guard shield projection extended through an opening in said flat position.

14. The safety guard equipped cardboard cutter of claim 13, wherein said resiliently deflectable spring safety guard and said second resiliently defleatable spring safety guard together have guard shield projections located transversally to both sides of the cutting edge downward projection of said blade one to the back and one to the front.

15. The safety guard equipped cardboard cutter of claim 14, wherein said resiliently deflectable spring safety guard and said second resiliently deflectable spring safety guard are duplicates one of the other.

* * * * *